US010631592B2

(12) United States Patent
Lee-Sang

(10) Patent No.: US 10,631,592 B2
(45) Date of Patent: Apr. 28, 2020

(54) ARTICLE OF FOOTWEAR

(71) Applicant: Natalie Chereen Sarah Lee-Sang, London (GB)

(72) Inventor: Natalie Chereen Sarah Lee-Sang, London (GB)

(73) Assignee: Natalie Chereen Sarah Lee-Sang, London (GB)

( * ) Notice: Subject to any disclaimer, the term of this patent is extended or adjusted under 35 U.S.C. 154(b) by 291 days.

(21) Appl. No.: 14/999,965

(22) PCT Filed: Jun. 24, 2014

(86) PCT No.: PCT/GB2014/000253
§ 371 (c)(1),
(2) Date: Dec. 22, 2015

(87) PCT Pub. No.: WO2014/207423
PCT Pub. Date: Dec. 31, 2014

(65) Prior Publication Data

US 2017/0119092 A1 May 4, 2017

(30) Foreign Application Priority Data

Jun. 24, 2013 (GB) ..... 1311208.1

(51) Int. Cl.
*A43B 1/10* (2006.01)
*A43B 13/18* (2006.01)
(Continued)

(52) U.S. Cl.
CPC ..... *A43B 13/186* (2013.01); *A43B 1/0009* (2013.01); *A43B 9/14* (2013.01);
(Continued)

(58) Field of Classification Search
CPC ..... A43B 13/186; A43B 13/04; A43B 13/125; A43B 13/188; A43B 13/40; A43B 23/028;
(Continued)

(56) References Cited

U.S. PATENT DOCUMENTS 1,605,408 A * 11/1926 Huiskamp ..... A43B 7/06 36/3 B
D114,511 S 4/1939 Renaldo
(Continued)

FOREIGN PATENT DOCUMENTS

EP 0018663 A1 11/1980
EP 1201143 A1 5/2002
(Continued)

OTHER PUBLICATIONS

Search Report under Section 17 for corresponding Application No. GB1311208.1, dated Dec. 22, 2014, pp. 1-4.
(Continued)

*Primary Examiner* — Timothy K Trieu
(74) *Attorney, Agent, or Firm* — Tarolli, Sundheim, Covell & Tummino LLP

(57) ABSTRACT

An article of footwear, such as a high heeled shoe, has a resilient midsole layer having a thickness of at least about 5 mm which is formed in a lattice arrangement for providing comfort to the wearer.

16 Claims, 3 Drawing Sheets

(51) Int. Cl.

| | |
|---|---|
| ***A43B 13/12*** | (2006.01) |
| ***A43B 21/00*** | (2006.01) |
| ***A43B 9/14*** | (2006.01) |
| ***A43B 1/00*** | (2006.01) |
| ***A43B 13/04*** | (2006.01) |
| ***A43B 13/40*** | (2006.01) |
| ***A43B 23/02*** | (2006.01) |

(52) U.S. Cl.
CPC ..... *A43B 13/04* (2013.01); *A43B 13/125* (2013.01); *A43B 13/181* (2013.01); *A43B 13/187* (2013.01); *A43B 13/188* (2013.01); *A43B 13/40* (2013.01); *A43B 21/00* (2013.01); *A43B 23/028* (2013.01)

(58) Field of Classification Search
CPC ..... A43B 1/0009; A43B 7/145; A43B 7/1425; A43B 3/0042
USPC ..... 36/28–29, 35 R, 34 R, 72 R
See application file for complete search history.

(56) References Cited

U.S. PATENT DOCUMENTS

| | | | | |
|---|---|---|---|---|
| 2,419,629 | A | 4/1947 | Colella | |
| 4,041,618 | A | 8/1977 | Famolare, Jr. | |
| 4,223,456 | A | 9/1980 | Cohen | |
| 4,335,530 | A * | 6/1982 | Stubblefield | A43B 5/00 36/30 R |
| 4,485,568 | A * | 12/1984 | Landi | A43B 1/0009 36/103 |
| 5,197,207 | A * | 3/1993 | Shorten | A43B 1/0009 36/102 |
| 5,201,125 | A * | 4/1993 | Shorten | A43B 1/0009 36/28 |
| 5,381,607 | A | 1/1995 | Sussmann | |
| 9,204,680 | B2 * | 12/2015 | Hoffer | A43B 1/0009 |
| 2006/0026867 | A1 | 2/2006 | Polcek | |
| 2006/0218820 | A1 | 10/2006 | Baden et al. | |
| 2009/0094856 | A1 | 4/2009 | Guerra | |
| 2012/0005920 | A1 | 1/2012 | Alvear et al. | |
| 2012/0180335 | A1 | 7/2012 | Mahoney | |
| 2012/0266492 | A1 | 10/2012 | Youngs et al. | |

FOREIGN PATENT DOCUMENTS

| | | | |
|---|---|---|---|
| EP | 2241208 | A1 | 10/2010 |
| GB | 228615 | A | 2/1925 |
| GB | 2314251 | A | 12/1997 |
| WO | 2013/074562 | A2 | 5/2013 |

OTHER PUBLICATIONS

PCT International Search Report for corresponding International Application No. PCT/GB2014/000253, dated Oct. 27, 2014, pp. 1-5.

* cited by examiner

ARTICLE OF FOOTWEAR

This invention relates to high-heeled footwear, and in particular to high-heeled shoes or boots.

A problem with high heeled shoes is that they can become uncomfortable after extended periods of wear. High heeled shoes are often preferred in particular by women for formal or other occasions where smart dress is required. However wearers often experience pain or discomfort after a short period particularly of standing, walking or dancing. This leads to some wearers needing to carry with them a pair of flatter shoes to change into if the discomfort becomes excessive or for walking any significant distances, which can be inconvenient. Alternatively a wearer may feel the need to choose flatter shoes than they would have preferred to wear on some occasions due to reasons of comfort.

Some shoes, including flat shoes, have a thin cushion layer provided as part of the insole of the shoe in an attempt to improve comfort. Thin gel cushions are also available separately to be inserted into the shoe under the ball of the foot to alleviate the discomfort in this area. However these measures tend to make only a minor improvement to comfort, and still do not allow extended wear of the shoes without discomfort or pain. It is an object of the invention to improve the comfort of high heeled footwear such as shoes or boots.

Thus according to the present invention, there is provided an article of footwear having a sole and an upper, the sole comprising an outsole and an insole and a cushioning midsole layer between the insole and the outsole, in which the midsole layer comprises a resilient material formed in a lattice arrangement, with an array of hollow cells being provided between upright walls of the resilient material, the midsole layer having a thickness of at least about 5 mm, in which the midsole layer includes a shaped cushion element 26 embedded in the forepart and/or in the heel part thereof, in which the shaped cushion element 26 has a substantially toroid shape, and in which a heel end of the sole is raised by between about 50 mm and about 150 mm relative to a forepart of the sole.

Thus the midsole layer provides a comfortable 'mattress' for the foot, improving the wearability of the shoe. It has been found that a resilient lattice material is particularly suitable for this purpose since it provides cushioning whilst substantially maintaining its shape, which is advantageous for formal or 'smart' shoes. The shoe is high-heeled, such that the heel part of the sole is raised by between about 50 mm and about 150 mm relative to the forepart The midsole layer may be provided in the forepart only of the sole, where more discomfort is generally felt, or preferably is provided over substantially the entire area of the sole for greater comfort. The midsole layer is preferably at least about 25 mm thick, and more preferably between about 30 and 40 mm thick. The sole may include a substantially rigid lateral outer layer to maintain the shape of the shoe even when the midsole layer is deformed during wear.

The substantially toroid shaped cushion element 26 may provide additional comfort and 'spring' during use. For example, the toroid element may be substantially solid, for example in the form of a rubber cushion, or may be at least partially hollow, such as an air cushion, or may be formed of another suitable material.

The midsole may be arranged to have a variable firmness dependent upon the shape or pressure distribution of the foot, for optimum comfort and/or in order to assist balance. For example, the midsole may be a bespoke element which may be made according to measurements such as shape or pressure measurements taken from the user's foot. This may be achieved for example by 3D printing of the midsole lattice layer, the 3D printing being programmed individually according to the individual's requirements.

The insole layer is preferably flexible or semi-flexible, and may be simply a layer of fabric. Optionally, where the insole layer is semi-flexible, it may extend around the outer periphery of the sole area only, at least in the forepart of the sole. The insole may also include a soft cushioning or foam layer, for example memory foam, which may extend over the cut out area. The foam layer may also extend over the inside of the upper for additional comfort and snugness of fit. This may be lined with a leather or similar lining.

In order that the invention may be more readily understood, reference will now be made to the accompanying drawings, in which.

Figure 1:
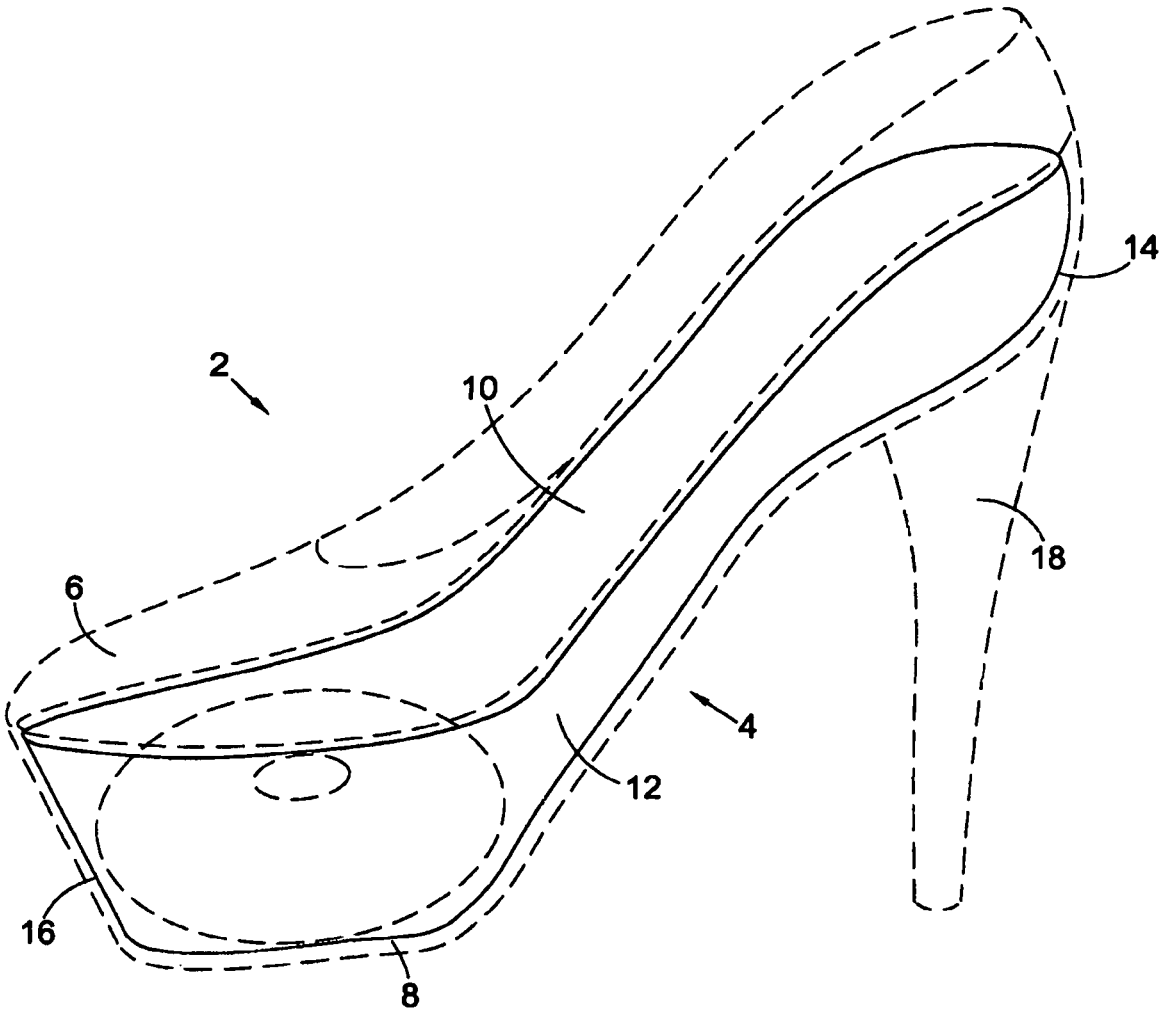
FIG. 1 is a perspective view of a shoe according to one embodiment of the invention, showing the structure of the midsole.

Referring to FIG. 1, a shoe 2 comprises a sole 4 and an upper 6. The sole comprises an outsole 8, an insole 10 and a midsole layer 12 between the outsole and the insole. The outsole 8 may be of standard construction, and is commonly made of a suitable hardwearing material as is known in the art for contact with the ground during use of the shoe, such as a rubber material. The insole 10 may also be of standard construction, and is commonly made from a relatively thin soft covering for contact with the wearer's foot or sock, such as leather or artificial leather or other fabric, sometimes including a thin compressible element. The upper 6 is also of a standard type, commonly made of leather or a leather substitute material in the required shape according to the aesthetic design of the shoe, and in order to hold the shoe onto the wearer's foot. In this example the upper is shown in the style of a simple ladies court shoe, but it could also be in any other design for example being formed of straps such as in the case of a sandal.

The heel end 14 of the sole is raised off the ground relative to the forepart 16 of the sole by a heel element 18. The heel element is of standard type, generally being a thin or tapering element providing support across the heel area of the sole and extending therefrom in the case of a stiletto type shoe as shown in the figures. The heel element could also be in other forms such as a broader element or a wedge-shaped element which supports the sole additionally in the arch area 24, according to the style of the shoe. The sole and heel may alternatively be made as one component for a more sturdy shoe.

Figure 2:
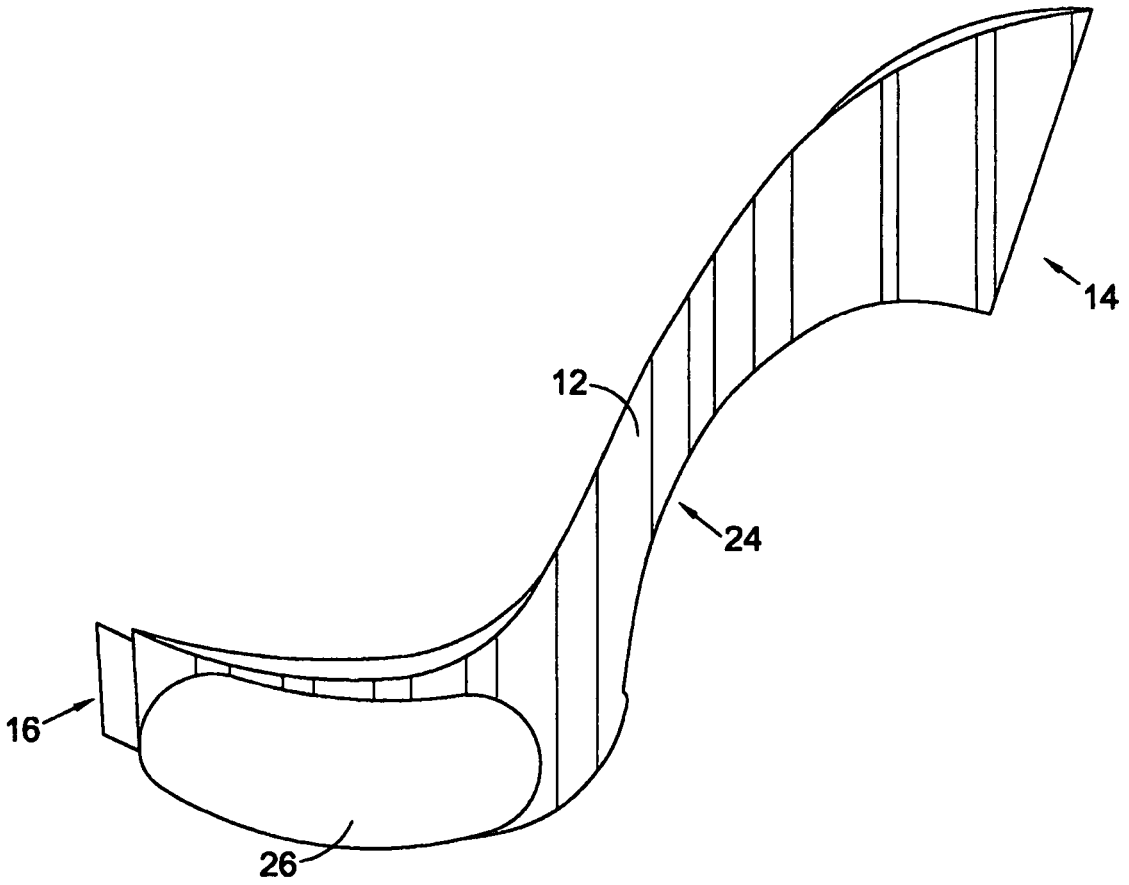
FIG. 2 is a cross-sectional side view of the midsole of FIG. 1.
Figure 3:
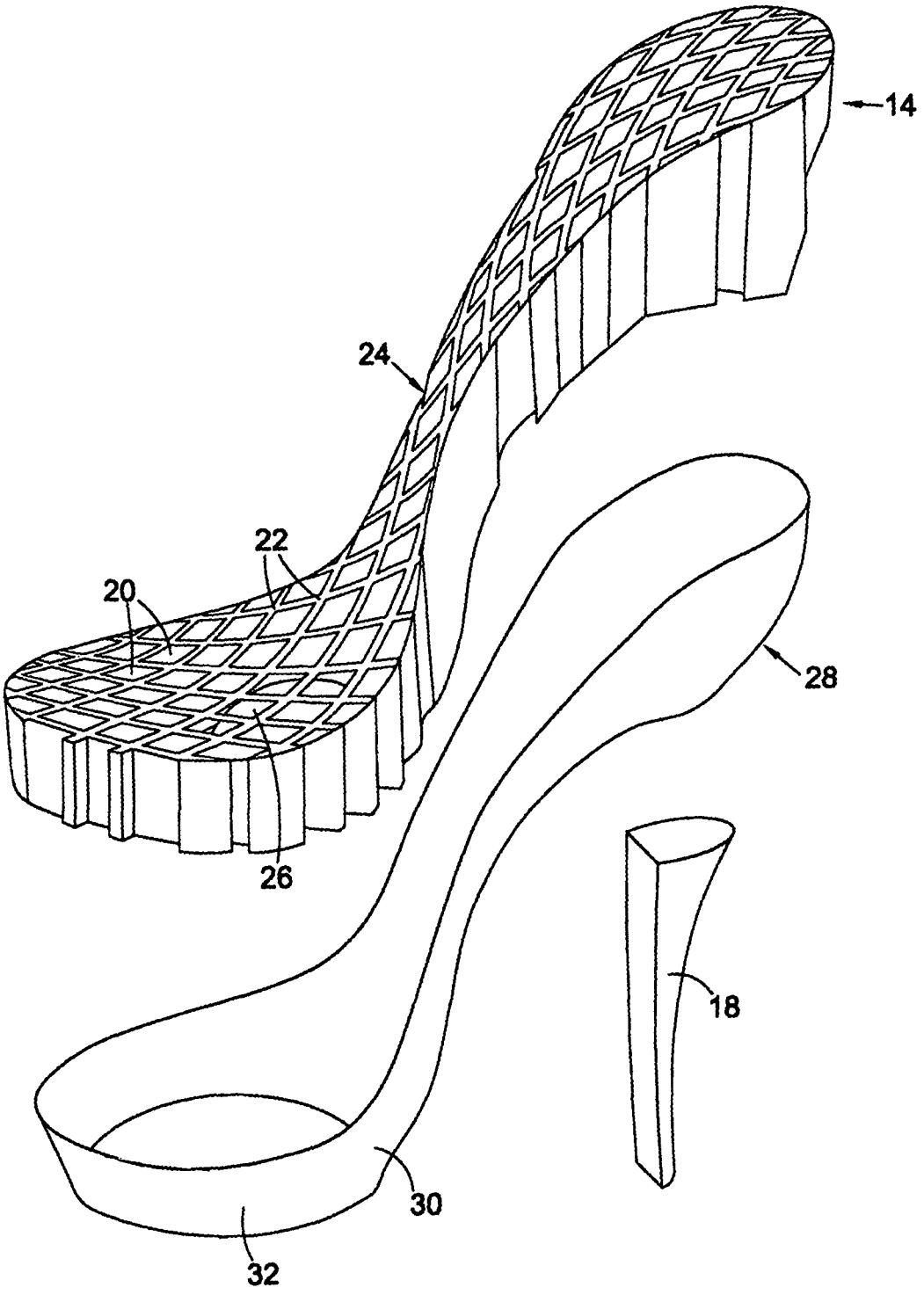
FIG. 3 is a perspective view of the sole of the shoe of FIG. 1 with the parts separated.

Referring also to FIG. 2 and FIG. 3, the midsole layer 12 is formed of a resilient material having a lattice formation, with an array of hollow cells 20 between upright walls 22. In this example the lattice forms diamond or square shaped cells, but it is envisaged that other shapes such as a honeycomb formation may also be suitable. In this example the cells are in the region of one centimeter in width, but could be smaller or larger than this depending upon the material used and/or the resilience required. Alternatively the midsole layer may be formed of a solid gel or rubber material.

The material is such that the midsole layer 12 may be somewhat compressed bearing the weight of a person's foot during wear, so as to provide a cushioning effect. For example, the midsole may compress in the upright direction by between about 10% and 20% when in use. The midsole layer in this example extends across substantially the entire area of the sole from the forepart end 16 to the heel end 14. In other examples, the midsole layer may be present in the forepart only of the sole, supporting the ball of the foot and the toe area, and may taper off towards the arch area 24 of the sole.

The thickness of the layer may be substantially consistent or may vary over the area of the sole. For example, it may be thicker in the forepart area for providing additional cushioning to the ball of the foot, or it may be thicker in the heel area to provide additional heel height. The layer thickness may thus vary over the area of the sole, for reasons of comfort and/or of the style of the shoe, since the midsole layer will provide the appearance of a platform sole in the finished shoe if sufficiently thick. In this example, the layer is thicker in the heel area 14 and forefoot area 16, and thinner in the arch area 24 since the arch area of the foot tends to bear less weight and so requires less cushioning.

Furthermore it is envisaged that the midsole may be provided as a bespoke element made to suit measurements taken from the user's foot. For example, the thickness or resilience of the midsole layer may vary over the area of the sole depending upon the shape or pressure distribution measured. One method of manufacturing such a midsole would be by 3D printing.

In the forefoot area of the midsole layer 12, a shaped spring element 26, here substantially in the shape of a torus, may be embedded in the lattice towards the lower or outsole surface of the layer. The torus element is also formed of a resilient material. The torus element may provide additional support and resistance to deformation in the area of the ball of the foot where the greatest pressure is exerted by the wearer's foot in use of the shoe. The torus shape has also been found to provide advantages in comfort and support in terms of distributing the weight over the ball of the foot. However, the element may be a different shape such as a substantially circular or oval shape, or may be more deformable or springy depending upon requirements.

The midsole layer 12 (which is shown in FIG. 1 and FIG. 2) is shaped so as to fit snugly in an outer casing 28 for the sole (the outer casing 28 is shown in FIG. 3) which covers at least the sides and preferably also forms the outsole covering the base of the midsole layer 12. The casing 28 thus has a base 30 surrounded by an upright side wall 32. At least the side wall 32 may be relatively rigid, substantially to prevent deformation of the outer shape of the shoe in use. This preserves the appearance of the shoe during wear. The heel element 18 may be attached to the underneath of the casing. The rigid parts of the sole such as the casing side wall 32 are preferably formed of a strong and light material which can be formed into a thin layer, for example graphene.

The insole 10 may be more rigid at the periphery thereof, and may have a cut out in the central region (not shown), which may include a further cushioning layer, for example of foam material such as memory foam. The inner surface of the upper may also comprise such a layer to provide further comfort and snugness of fit.

The invention claimed is:

1. An article of footwear having a sole and an upper, the sole having a forepart and a heel end, the sole comprising an outsole and an insole and a cushioning midsole layer between the insole and the outsole, in which the cushioning midsole layer is provided at least in the forepart of the sole and comprises a resilient material, with an array of hollow cells being provided in the resilient material, the array of hollow cells extending in two orthogonal directions, the cushioning midsole layer having a thickness of at least 5 mm, in which the midsole layer includes a shaped cushion element embedded in the hollow cells of the cushioning midsole layer in the forepart of the sole, in which the heel end of the sole is raised by between 50 mm and 150 mm relative to the forepart of the sole, and in which the shaped cushion element is provided between the insole and the outsole so that the outsole prevents the shaped cushion element from contacting the ground.

2. The article of footwear as claimed in claim 1, in which the cushioning midsole layer has a thickness of between at least 10 mm, and up to 50 mm.

3. The article of footwear as claimed in claim 1, in which the cushioning midsole layer has a thickness of at least 25 mm.

4. The article of footwear as claimed in claim 3, in which the cushioning midsole layer has a thickness of between 30 and 40 mm.

5. The article of footwear as claimed in claim 1, in which the cushioning midsole layer extends across substantially the entire forepart region of the sole.

6. The article of footwear as claimed in claim 1, in which the cushioning midsole layer extends across substantially the entire area of the sole.

7. The article of footwear as claimed in claim 1, in which the midsole is arranged to deform up to 20% in thickness during use.

8. The article of footwear as claimed in claim 1, in which the cushioning midsole layer is arranged to have a resilience which varies over the area thereof.

9. The article of footwear as claimed in claim 1, in which the sole comprises a substantially rigid lateral outer layer for maintaining the shape of the shoe in use.

10. The article of footwear as claimed in claim 1, in which the shaped cushion element has a substantially toroid shape.

11. The article of footwear as claimed in claim 1, in which the insole has a central forepart region, and the insole comprises a thin cushioning layer, at least in the central forepart region of the insole.

12. The article of footwear as claimed in claim 1, in which the upper has an inside surface, and at least a portion of the inside surface of the upper is provided with a thin cushioning layer.

13. The article of footwear as claimed in claim 1, in which the cushioning midsole layer is formed of a gel or rubber material.

14. The article of footwear as claimed in claim 1, in which the array of hollow cells is provided between upright walls of the resilient material.

15. The article of footwear as claimed in claim 1, in which the resilient material is formed in a lattice arrangement, with the array of hollow cells being provided in the resilient material forming the lattice arrangement.

16. The article of footwear as claimed in claim 15, in which the lattice arrangement forms diamond or square shaped cells or a honeycomb formation.

* * * * *